US007775865B2

(12) United States Patent
Livchak et al.

(10) Patent No.: US 7,775,865 B2
(45) Date of Patent: Aug. 17, 2010

(54) SET AND FORGET EXHAUST CONTROLLER

(75) Inventors: Andrey V. Livchak, Bowling Green, KY (US); Derek W. Schrock, Bowling Green, KY (US)

(73) Assignee: Oy Halton Group Ltd., Vantaa (FI)

( * ) Notice: Subject to any disclaimer, the term of this patent is extended or adjusted under 35 U.S.C. 154(b) by 254 days.

(21) Appl. No.: 11/570,634

(22) PCT Filed: Jun. 21, 2005

(86) PCT No.: PCT/US2005/021969

§ 371 (c)(1),
(2), (4) Date: Jun. 28, 2007

(87) PCT Pub. No.: WO2006/002190

PCT Pub. Date: Jan. 5, 2006

(65) Prior Publication Data

US 2008/0045132 A1 Feb. 21, 2008

Related U.S. Application Data

(60) Provisional application No. 60/581,751, filed on Jun. 22, 2004.

(51) Int. Cl.
*F24C 15/20* (2006.01)
*B08B 15/02* (2006.01)

(52) U.S. Cl. ..... 454/67; 454/256; 126/299 D; 126/299 R

(58) Field of Classification Search ..... 454/61, 454/67, 256; 126/299 D, 299 R
See application file for complete search history.

(56) References Cited

U.S. PATENT DOCUMENTS

| | | | |
|---|---|---|---|
| 4,022,118 | A | 5/1977 | Vandas |
| 4,066,064 | A | 1/1978 | Vandas |
| 4,105,015 | A | 8/1978 | Isom |
| 4,186,727 | A | 2/1980 | Kaufman et al. |
| 4,372,195 | A | 2/1983 | Dorius |

(Continued)

FOREIGN PATENT DOCUMENTS

EP 1 035 644 A1 9/2000

(Continued)

OTHER PUBLICATIONS

International Search Report dated Feb. 22, 2006 for underlying International Application No. PCT/US05/21969.

(Continued)

*Primary Examiner*—Steven B McAllister
*Assistant Examiner*—Patrick F. O'Reilly, III
(74) *Attorney, Agent, or Firm*—Mark A. Catan; Miles & Stockbridge P.C.

(57) ABSTRACT

A controller automatically determines drive signals by testing an exhaust system, either immediately after installation or at selected times thereafter, to determine the drive signal values that correspond to each of one or more selected flow rates. The drive signals are stored. Thereafter, the controller uses the stored values of drive signals to control the exhaust system. This avoids problems with real time control such as drift or failure of sensors and such which are very common in commercial exhaust installations.

10 Claims, 5 Drawing Sheets

U.S. PATENT DOCUMENTS

| | | | | |
|---|---|---|---|---|
| 4,407,266 | A | 10/1983 | Molitor | |
| 4,483,316 | A | 11/1984 | Fritz et al. | |
| 4,484,563 | A | 11/1984 | Fritz et al. | |
| 4,539,469 | A | 9/1985 | Gigandet | |
| 4,551,600 | A | 11/1985 | Miyagawa et al. | |
| 4,552,059 | A | 11/1985 | Potter | |
| 4,784,114 | A | 11/1988 | Muckler et al. | |
| 4,887,587 | A | 12/1989 | Deutsch | |
| 4,903,894 | A | 2/1990 | Pellinen et al. | |
| 4,971,023 | A | 11/1990 | Martinez | |
| 4,978,896 | A * | 12/1990 | Shah | 318/400.08 |
| 5,042,456 | A | 8/1991 | Cote | |
| 5,139,009 | A | 8/1992 | Walsh | |
| 5,269,660 | A * | 12/1993 | Pradelle | 417/18 |
| 5,736,823 | A * | 4/1998 | Nordby et al. | 318/432 |
| 6,104,016 | A | 8/2000 | Lee | |
| 6,170,480 | B1 | 1/2001 | Melink et al. | |
| 6,173,710 | B1 | 1/2001 | Gibson et al. | |
| 6,353,303 | B1 * | 3/2002 | Ramachandran et al. | 318/727 |
| 6,472,843 | B2 * | 10/2002 | Smith et al. | 318/727 |
| 6,789,462 | B1 | 9/2004 | Hamilton | |
| 6,851,421 | B2 | 2/2005 | Livchak et al. | |
| 6,869,468 | B2 | 3/2005 | Gibson | |
| 6,878,195 | B2 | 4/2005 | Gibson | |
| 6,899,095 | B2 | 5/2005 | Livchak et al. | |
| 7,147,168 | B1 | 12/2006 | Bagwell et al. | |
| 7,364,094 | B2 | 4/2008 | Bagwell et al. | |
| 2003/0146082 | A1 | 8/2003 | Gibson et al. | |
| 2004/0101412 | A1 * | 5/2004 | Kallman et al. | 417/44.1 |
| 2004/0149278 | A1 | 8/2004 | Lin | |
| 2005/0224069 | A1 | 10/2005 | Patil et al. | |
| 2005/0229922 | A1 | 10/2005 | Magner et al. | |
| 2005/0279845 | A1 | 12/2005 | Bagwell et al. | |
| 2006/0032492 | A1 | 2/2006 | Bagwell et al. | |
| 2006/0219235 | A1 | 10/2006 | Bagwell et al. | |
| 2006/0278215 | A1 | 12/2006 | Gagas et al. | |
| 2007/0015449 | A1 | 1/2007 | Livchak | |
| 2007/0023349 | A1 | 2/2007 | Kyllonen et al. | |
| 2007/0068509 | A1 | 3/2007 | Bagwell et al. | |
| 2007/0272230 | A9 | 11/2007 | Meredith et al. | |
| 2008/0207109 | A1 | 8/2008 | Bagwell et al. | |
| 2008/0302247 | A1 | 12/2008 | Magner et al. | |
| 2008/0308088 | A1 | 12/2008 | Livchak et al. | |
| 2009/0032011 | A1 | 2/2009 | Livchak et al. | |

FOREIGN PATENT DOCUMENTS

| | | | |
|---|---|---|---|
| JP | 05146189 | A * | 6/1993 |
| WO | WO 83/00377 | | 2/1983 |
| WO | WO 97/48479 | | 12/1997 |
| WO | WO 02/14728 | | 2/2002 |
| WO | WO 2005/114059 | | 12/2005 |
| WO | WO 2007/121461 | | 10/2007 |
| WO | WO 2008/157418 | | 12/2008 |

OTHER PUBLICATIONS

Written Opinion of the International Searching Authority dated Feb. 22, 2006 for underlying International Application No. PCT/US05/21969.

* cited by examiner

SET AND FORGET EXHAUST CONTROLLER

CROSS-REFERENCE TO RELATED APPLICATIONS

This application is a national stage entry of International Application No. PCT/US2005/021969, filed Jun. 21, 2005, which claims the benefit of 60/581,751, filed Jun. 22, 2004, the entireties of which are hereby incorporated by reference.

BACKGROUND

One of the problems with installing exhaust hoods in industrial, commercial, and large residential systems is adjusting the flow rate of each hood so that a minimum volume of air is exhausted to ensure capture, containment, and removal of effluent. The performance of a hood, however, is very variable depending upon how it is installed. Often, unforeseen adjustments made in the size and length of ducting and other variables established during installation make it impossible to select an exhaust blower configuration which will deliver a desired exhaust flow once a hood is installed. Because of the cost of unnecessarily high exhaust capacity, it is important to establish a desired exhaust flow upon installation.

Currently, one way of dealing with this problem is for an installer to perform a flow measurement and make adjustments to a fan system to establish a desired flow. However, such field measurements and procedures are time consuming and subject to error and common sloppiness.

SUMMARY

Briefly, a controller automatically determines drive signals by testing an exhaust system, either immediately after installation or at selected times thereafter, to determine the drive signal values that correspond to each of one or more selected flow rates. The drive signals are stored. Thereafter, the controller uses the stored values of drive signals to control the exhaust system. This avoids problems with real time control such as drift or failure of sensors and such which are very common in commercial exhaust installations. A variable frequency motor drive can be used, for example. The system may be used in combination with real time control. If a failure of the real time control system is detected such as by detecting out-of-range sensor or drive signal (for feed-forward control) values, the controller can default to the stored drive signal values.

DETAILED DESCRIPTION OF THE EMBODIMENTS

Figure 1:
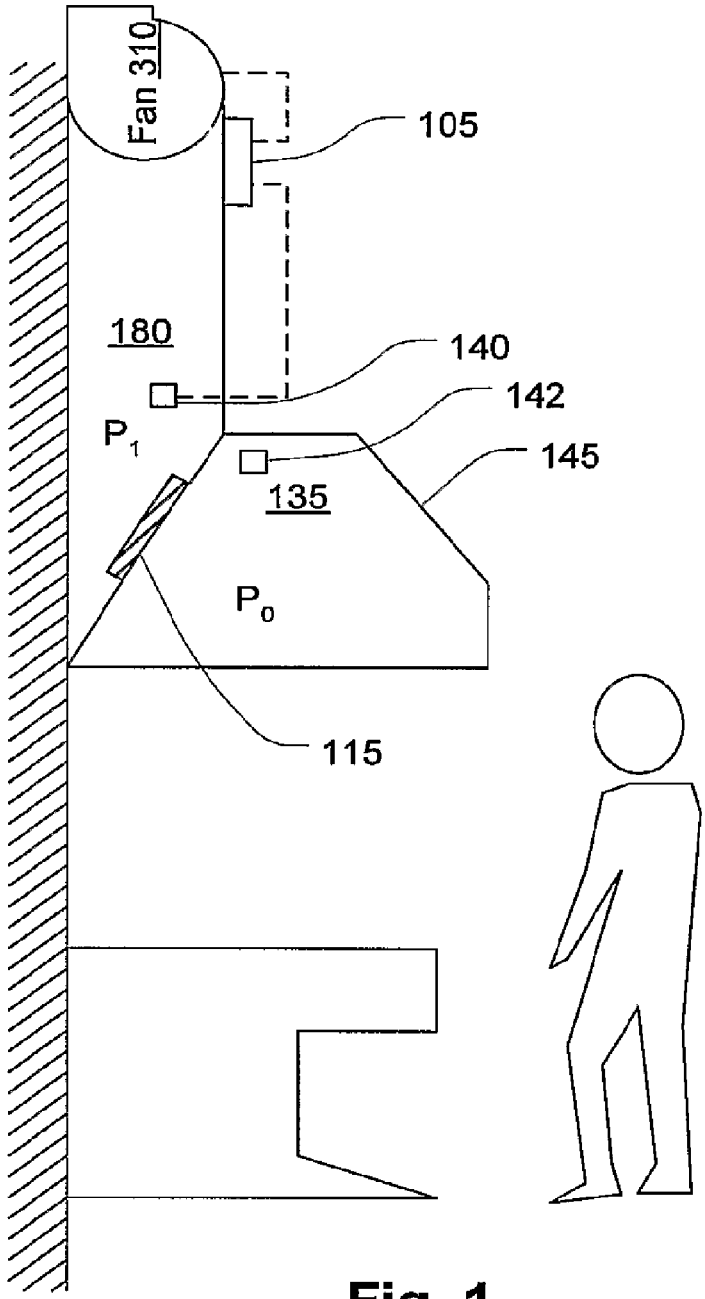
FIG. 1 is an illustration of an exhaust hood with a flow control system.

FIG. 1 illustrates an exhaust hood 145 with a flow controller/drive unit 105. A fan 310 draws air through a duct 180 that leads away from recess 135 of the exhaust hood 145. A filter 115 separates the recess 135 from the duct 180 and causes a pressure drop due to the known effect of grease filters in such applications. A pressure sensor 140 measures a static pressure which can be converted to a flow rate based on known techniques due to the flow resistance caused by the filter 115. A differential pressure reading may also be generated using an additional pressure sensor 142 or a differential sensor (not shown separately) with taps upstream and downstream of the filter.

Instead of a filter, reference numeral 115 may represent an orifice plate or other calibrated flow resistance device and may include a smooth inlet transition (not shown separately) to maximize precision of flow measurement by means of pressure loss. Instead of pressure sensors, reference numeral 140 may represent a flow measurement device such as one based on a pitot tube, hot wire anemometer, or other flow sensor. The sensor 140 may be replaceable since, as discussed below, it is used only once or intermittently so that replacement would not impose an undue burden.

Figure 2:
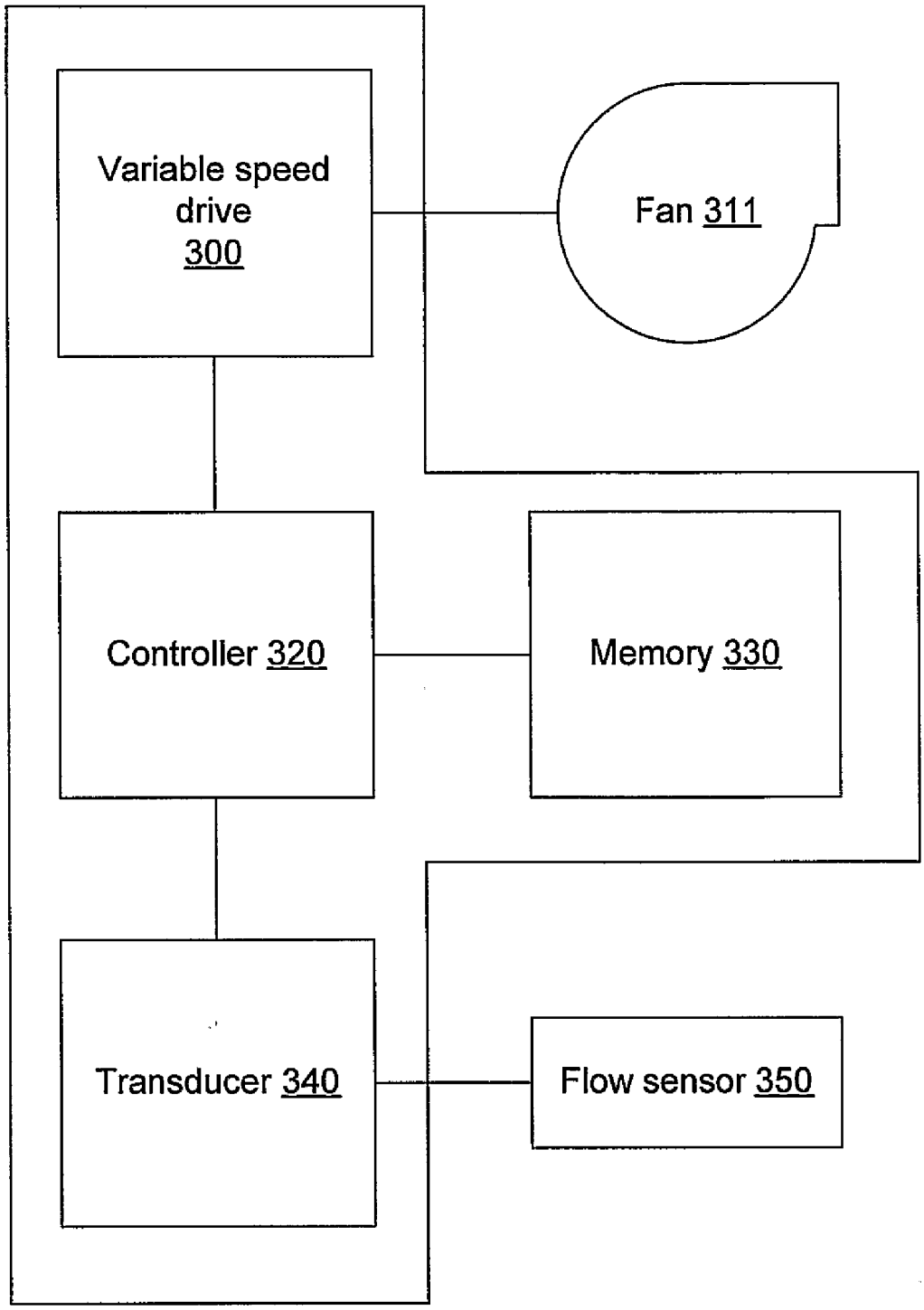
FIG. 2 is a more detailed illustration of a control system shown in FIG. 1.

FIG. 2 illustrates details of the controller/drive unit 105 according to an embodiment of the invention. A fan 311, which may correspond to the fan 310 of FIG. 1, is driven at a selected speed by a variable speed drive 300. The latter may be an electronic drive unit or a mechanical drive with a variable transmission or any other suitable device which may receive and respond to a control signal from a controller 320. The latter is preferably an electronic controller such as one based on a microprocessor. The controller 320 accesses stored data in a memory 330. The memory may contain calibration data such as required to determine flow rate from pressure readings or anemometer signals (illustrated generally as a transducer 340 and flow sensor 350). In addition, the memory 330 may also store a predetermined flow rate value at which the associated exhaust hood 145 (See FIG. 1) is desired to operate. Thus, the controller 320 can determine a current flow rate and compare it to a stored value and make corresponding adjustments in fan speed (or otherwise control flow, such as by means of a damper).

The memory 330 also stores fan speed value so that once a particular fan speed is determined to achieve a desired flow rate (e.g., one predetermined value stored in memory 330), the associated fan speed can be stored in memory 330 and used to control the fan after that. In this way, the required fan speed need not be determined, as in common feedback control, each time the system operates. This is desirable because the accuracy of flow measurement devices is notorious for its tendency, particularly in dirty environments such as exhaust hoods, to degrade over time.

Figure 3:
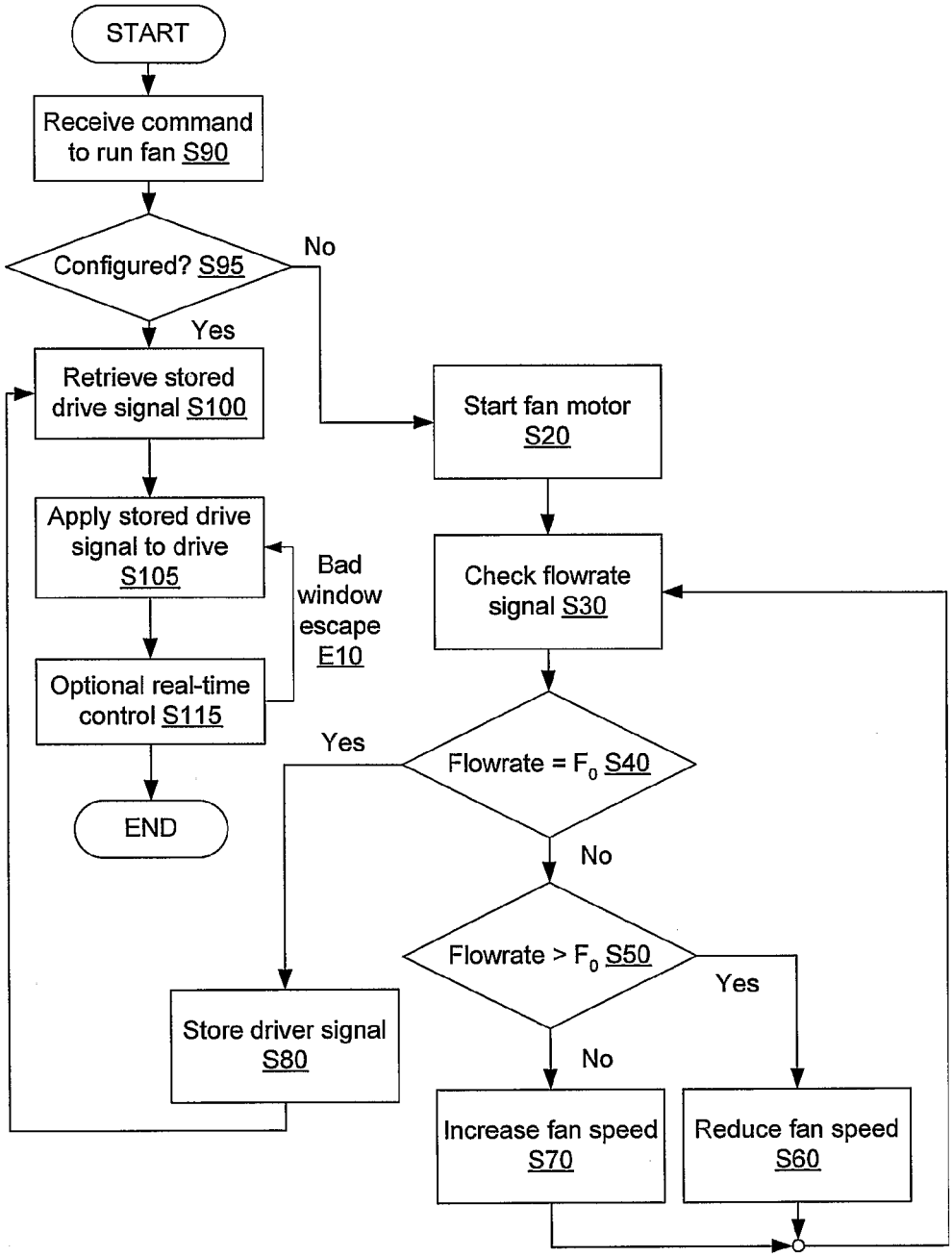
FIG. 3 is a flow chart illustrating a control method.

FIG. 3 illustrates a control procedure for use during set-up when a hood is installed. First a command is issued at step S90 to start the exhaust hood. In step S95, it is determined whether a fan speed has been determined by a configuration procedure. If not, control proceeds to step S20. In step S20 the fan is started and a flow rate measurement is made in step S30. The flow rate is compared with a value stored in the memory 330 at step S40 and if it is equal (assumed within a tolerance) to the predetermined value, control proceeds to step S80. If the flow rate is unequal it is determined if the flow rate is higher at step S50 and if so, the fan speed is increased at step S70 and if not, the fan speed is decreased at step S60. After step S60 or S70, the comparison is repeated at step S40 until the predetermined and measured flow rates are substantially equal.

In step S80, the value of the fan speed (or corollary such as a drive signal) is stored in the memory 330. In addition, step S80 may include the step of setting a flag to indicate that the procedure has been run and a desired fan speed value stored.

The stored value is retrieved at step S100 and applied to operate the fan at step S105. If the configuration process S20 to S80 had been run already, the flow would have gone from step S95 to step S100 directly resulting in the exhaust hood operating at the fan speed previously determined to coincide with the desired flow.

In another embodiment, the memorized driver signal is used as a default driver signal. Input control signals are permitted to supersede the default driver control when the difference between the desired level exceeds the default by a specified margin. The iterative control process is encapsulated in step S115. Iterative control may be according to any suitable real-time (feed-forward or feedback) control method, for example ones discussed in U.S. Pat. No. 6,170,480, hereby incorporated by reference as if set forth in its entirety, herein. In step S115, if the inputs of a feedback control signal lie outside a specified range, the default drive signal stored in the memory is used. Detection of an input range outside the specified range causes control to escape E10 and return to the default drive signal. If the feedback control signal(s) lie within the specified range, feedback control is used to determine the drive signal.

Figure 4A:
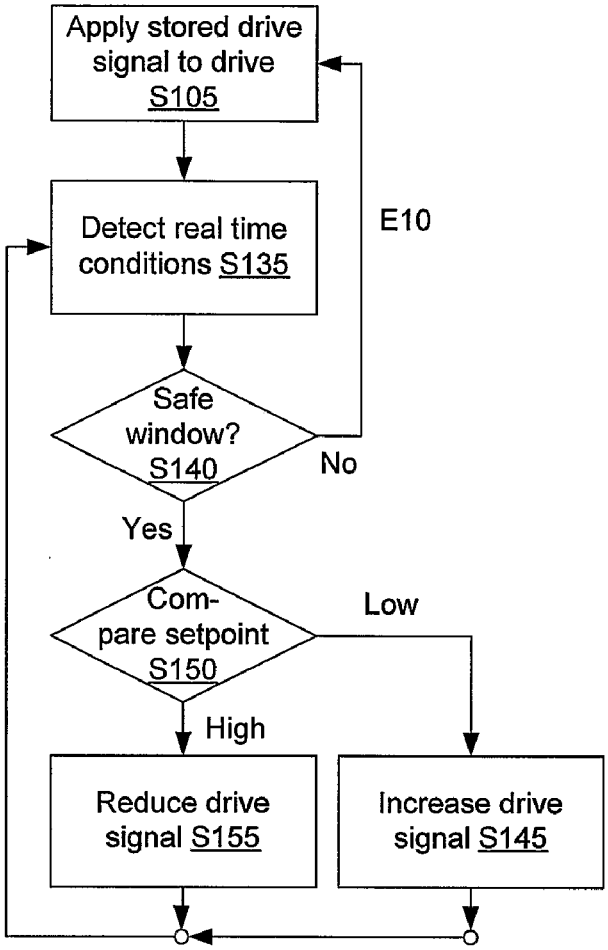
FIGS. 4A and 4B illustrate alternative details of a simple feedback or feed-forward control loop with the escape.
Figure 4B:
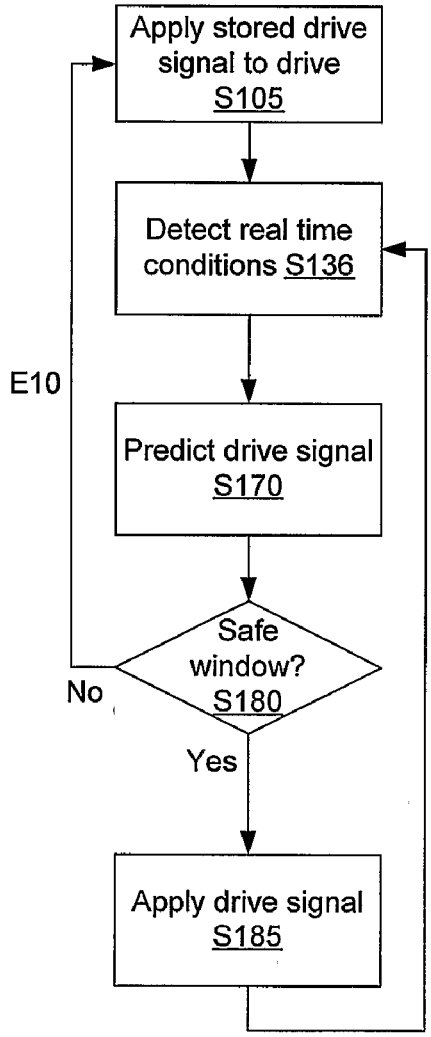

FIGS. 4A and 4B illustrate the possible details of a simple feedback or feed-forward control loop with the escape. Step S105 is the same as the similarly numbered step of FIG. 3. FIG. 4A corresponds to a feedback control method. A stored drive signal is applied by default to drive the fan. Then at step S135 the real time conditions are detected and converted to values or levels that can be compared with stored values or signal levels defining a safe operating window. At step S140, it is determined if the detected real time conditions are within the safe window. If they are, control proceeds to step S150 and if not, the escape path E10 is taken and stored default drive signals are applied. In step S150, a feedback setpoint is compared to the detected real time values of the feedback control signal and adjusted accordingly as indicated by steps S155 and S145, respectively whereupon control proceeds back to step S135.

FIG. 4B corresponds to a feed-forward control method. Step S105 is the same as the similarly numbered step of FIG. 3; a stored drive signal is applied by default to drive the fan. Then at step S136 the real time conditions are detected and converted to values or levels that can be compared with stored values or signal levels defining a safe operating window or used to generate a drive signal, at step S170, using a feed-forward control method.

Feed-forward control is not described here, but feed-forward control, in general, is conventional. An example of feed-forward control applied to a complex ventilation problem (among other things) is described in U.S. patent Ser. No. 10/638,754, entitled "Zone control of space conditioning system with varied uses" which is hereby incorporated by reference as if fully set forth in its entirety herein.

At step S180, the detected signals or the predicted drive signal are compared with values defining an allowed window and determined to be acceptable or not. In other words, S180 may compare a drive signal value to an allowed range stored in a memory of the controller or it may compare the real time condition signal to specified values stored in a controller memory, similar to step S140 of FIG. 4A. Detection of a value outside the specified range causes control to escape E10 and return to the default drive signal. Otherwise, the predicted drive signal is used to drive the exhaust system in step S185 and control returns to step S136.

Figure 5:
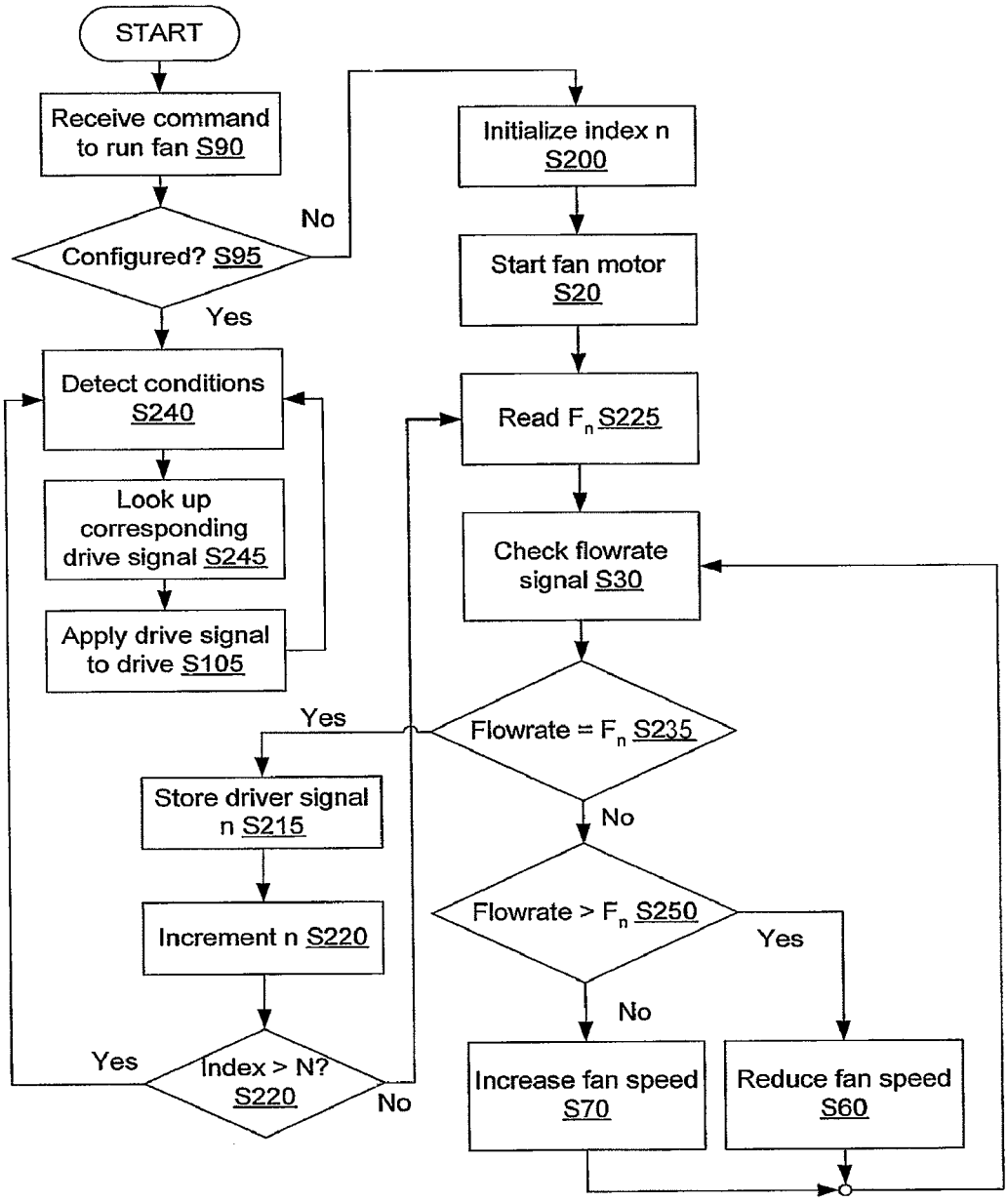
FIG. 5 illustrates a control method which is an alternative to the one of FIG. 3.

FIG. 5 illustrates another control procedure for use during set-up when a hood is installed. First, as in the embodiment of FIG. 3, a command is issued at step S90 to start the exhaust hood. In step S95, it is determined whether a fan speed has been determined by a configuration procedure. If not, control proceeds to step S200. In step S200, an index (counter value) n is initialized whose value will span the number of different control conditions to be covered by the instant procedure.

In step S20 the fan is started and a first stored value of a desired flow rate is read. Each of N flow rate values $F_n$ corresponds to a respective desired flow rate associated with a particular one of N operating conditions. Each $F_n$ is stored in a controller memory. A flow rate measurement is made in step S30 and compared with the current $F_n$ (the value of $F_n$ corresponding to the index value n initialized in step S200. If it is equal (assumed within a tolerance) to the predetermined value, control proceeds to step S215. If the flow rate is unequal, it is determined if the flow rate is higher at step S250 and if not, the fan speed is increased at step S70 and if so, the fan speed is decreased at step S60. After step S60 or S70, the comparison is repeated at step S235 until the current flow value $F_n$ and measured flow rates are substantially equal.

In step S215, the value of the fan speed (or corollary such as a drive signal) is stored in the $n^{th}$ one of N memory locations 330. In addition, step S215 may include the step of setting a flag to indicate that the procedure has been run and the desired fan speed values stored when n reach N. The value of the index n is incremented in step S220 and if all values of $F_n$ have not yet been set (as evaluated in step S220*b*), control returns to step S225. Otherwise control goes to step S240. Conditions are detected in step S240 and the associated stored value of the driver signal determined in step S245. The determined drive signal is then applied in step S105 and control loops back to step S240.

In another embodiment, the memorized driver signal is used as a default driver signal. Input control signals are permitted to supersede the default driver control when the difference between the desired level exceeds the default by a specified margin. The iterative control process is encapsulated in step S115. Iterative control may be according to any suitable real-time (feed-forward or feedback) control method, for example ones discussed in U.S. Pat. No. 6,170,480, hereby incorporated by reference as if set forth in its entirety, herein. In step S115, if the inputs of a feedback control signal lie outside a specified range, the default drive signal stored in the memory is used. Detection of an input range outside the specified range causes control to escape E10 and return to the default drive signal. If the feedback control signal(s) lie within the specified range, feedback control is used to determine the drive signal.

In step S240, the conditions detected may be, for example, the fume load predicted from one or more inputs. For example, the time of day (a restaurant that cooks according to a particular schedule) can be used to determine the fume load. Another input may be an indication of whether a protected fume source, such as a kitchen appliance, has been turned on and for how long. The fuel consumption rate may also be used. Other kinds of detection mechanisms may also be employed, such as described in U.S. Pat. No. 6,899,095 entitled "Device and method for controlling/balancing flow fluid flow-volume rate in flow channels," hereby incorporated by reference as if fully set forth in its entirety herein. Expected flow values for the following exhaust conditions are listed here for an example: (1) full load; (2) intermediate load; (3) idle; (4) initialization (e.g., burners turned on, but no cooking yet) in winter; (5) initialization in summer. The reason summer and winter (or it could be based on temperature) may be different is that the heat liberated by a heat source may be undesirable in summer but more acceptable during winter time.

The sensors used for feedback or feedforward control may include any of a variety of types which may be used to prevent escape of pollutants from an exhaust hood. The flow sensors used for determining drive signals associated with desired flow rates may be any type of flow sensor. Preferably, the flow sensor is one which is robust and which is not overly susceptible to fouling. One of the fields of application is kitchen range hoods, which tend to have grease in the effluent stream. For example, static pressure taps with pressure transducers in the exhaust duct may provide a suitable signal.

The invention claimed is:

1. A controller for an exhaust system including an exhaust hood, the controller comprising:

a programmable controller module (PCM) having a memory storing at least one value corresponding to a target flow rate;

said PCM having an input configured to, at a configuration time, receive a signal indicating a flow rate measurement;

said PCM having an output configured to output a drive signal to control a flow rate of the exhaust system;

said PCM being configured to adjust, at said configuration time, said drive signal to iteratively adjust the flow rate of the exhaust system responsively to said signal indicating a flow rate measurement until it substantially corresponds to said at least one value corresponding to a target flow rate, the drive signal corresponding to a load condition of the exhaust hood, the exhaust hood load condition being associated with a fume load generated by one or more appliances disposed underneath the exhaust hood;

said PCM being configured to store, at said configuration time, a value of said drive signal corresponding to said target flow rate in said memory;

said PCM being configured to receive, at a time subsequent to said configuration time, an input signal indicative of the exhaust hood load condition and being configured to output a corresponding value of said drive signal; and said PCM being further configured to control, at said time subsequent to said configuration time, the flow rate of said exhaust system according to said drive signal value stored in said memory.

2. A controller as in claim 1, wherein:

said PCM is configured to store multiple values, each corresponding to a respective flow rate, and to determine, at said configuration time, multiple values of said drive signal, each corresponding to a respective one of said multiple values each corresponding to a respective flow rate;

each of said drive signals corresponding to one of a plurality of load conditions of the exhaust hood; and said PCM is further configured to receive a plurality of input signals, each being indicative of one of the plurality of exhaust hood load conditions, and to output a corresponding value of said drive signal responsively thereto.

3. The controller according to claim 1, wherein the PCM is configured to control, at the time subsequent to said configuration time, the flow rate of said exhaust system according to said drive signal value stored in said memory and independent of the signal indicating the flow rate measurement.

4. A controller for an exhaust system including an exhaust hood, the controller comprising:

a control unit storing one or more target flow rate values;

said control unit being configured to, at a configuration time, iteratively adjust a flow rate in response to a flow measurement signal and thereby to automatically determine drive signals corresponding to each of said one or more target flow rate values, each of the drive signals corresponding to a respective load condition of the exhaust hood, the exhaust hood load conditions being associated with respective fume loads generated by one or more appliances disposed underneath the exhaust hood;

the control unit being configured to store the one or more drive signals corresponding to said one or more target flow rate values and thereafter use them to control the flow rate of the exhaust system;

wherein the control unit is being further configured to receive a plurality of input signals, each input signal being indicative of a respective exhaust hood load condition, and to output corresponding stored drive signals to control the flow rate of the exhaust system.

5. The controller according to claim 4, wherein the control unit is configured to control the flow rate of the exhaust system using the stored one or more drive signals independent of the flow rate measurement signal.

6. A flow control system for an exhaust system including an exhaust hood, the flow control system comprising:

a control module having an input, an output, and a memory, the input being configured to receive a flow rate signal indicative of a measurement of a flow rate in the exhaust system, the output being configured to supply a drive signal so as to control the flow rate in the exhaust system, the control module being configured:

in a first mode of operation, to iteratively adjust the drive signal responsively to the flow rate signal such that the flow rate in the exhaust system corresponds to a selected flow rate value stored in the memory, and to associate the adjusted drive signal with the selected flow rate value in the memory, the drive signal corresponding to a load condition of the exhaust hood, the exhaust hood load condition being associated with a fume load generated by one or more appliances disposed underneath the exhaust hood; and in a second mode of operation, to recall the associated drive signal from the memory and to supply the recalled drive signal to the output independent of the flow rate signal, wherein, the control module is configured to recall the associated drive signal based on an input signal indicative of the exhaust hood load condition, and wherein, the second mode of operation occurs after the first mode of operation.

7. The flow control system according to claim 6, wherein the control module is further configured, in a third mode of operation, to generate a drive signal responsive to the flow rate signal and independent of the associated drive signal in the memory, and to supply the generated drive signal to the output, the third mode of operation occurring after the first mode of operation but before the second mode of operation.

8. The flow control system according to claim 7, wherein the control module is configured to operate in the third mode of operation until an escape event is detected, the control module is configured to operate in the second mode of operation after an escape event is detected, and the escape event includes at least one of the flow rate signal being outside of a predetermined range for the flow rate signal and the generated drive signal being outside of a predetermined range for the drive signal.

9. The flow control system according to claim 6, further comprising a sensor configured to measure the flow rate in the exhaust system and to send a signal indicative thereof to the control module.

10. The flow control system according to claim 9, wherein the sensor is at least one of a pressure sensor, a pitot tube, and an anemometer.

* * * * *